US007918055B2

(12) United States Patent
Cotten

(10) Patent No.: US 7,918,055 B2
(45) Date of Patent: Apr. 5, 2011

(54) CONSTRUCTION SPACER

(76) Inventor: Kenneth K. Cotten, Oakdale, MN (US)

( * ) Notice: Subject to any disclaimer, the term of this patent is extended or adjusted under 35 U.S.C. 154(b) by 1083 days.

(21) Appl. No.: 11/298,786

(22) Filed: Dec. 9, 2005

(65) Prior Publication Data

US 2006/0137289 A1 Jun. 29, 2006

Related U.S. Application Data

(60) Provisional application No. 60/634,880, filed on Dec. 10, 2004.

(51) Int. Cl.
*E02D 19/00* (2006.01)
*E04B 1/70* (2006.01)
*E04B 5/00* (2006.01)

(52) U.S. Cl. ..... 52/169.5; 52/169.14; 52/302.3; 52/408

(58) Field of Classification Search ..... 52/169.5, 52/169.14, 169.1, 169.11, 302.1, 302.3, 408, 52/409, 403.1; 405/36, 38, 43, 45, 47, 48, 405/49, 50, 229, 251, 254; 16/225, 234, 16/235, 248

See application file for complete search history.

(56) References Cited

U.S. PATENT DOCUMENTS 3,279,474 A * 10/1966 Toman et al. ..... 281/21.1
3,351,270 A * 11/1967 Hohnjec ..... 220/835
4,027,714 A * 6/1977 Dixon et al. ..... 160/84.08
4,194,313 A * 3/1980 Downing ..... 40/610
4,636,065 A * 1/1987 Kanemitsu et al. ..... 355/75
4,745,716 A * 5/1988 Kuypers ..... 52/169.5
5,044,821 A * 9/1991 Johnsen ..... 405/50
5,450,694 A * 9/1995 Goranson et al. ..... 52/71
5,794,388 A * 8/1998 Jackman ..... 52/169.5
5,820,296 A * 10/1998 Goughnour ..... 405/43
6,122,874 A * 9/2000 Smerilli ..... 52/408
6,241,421 B1 * 6/2001 Harvie et al. ..... 405/45
6,672,016 B2 * 1/2004 Janesky ..... 52/169.5
6,691,472 B2 * 2/2004 Hubert ..... 52/169.5
2002/0139068 A1 * 10/2002 Janesky ..... 52/169.5
2003/0156905 A1 * 8/2003 Hubert ..... 405/229
2006/0112653 A1 * 6/2006 Hogenson ..... 52/169.5

OTHER PUBLICATIONS http://www.cactusboard.com/tips.html, "CactusBoard Floor Edging, Installation Tips," 1 page.
http://www.basementwaterproof.com/quality.html, "Beaver® Basement Water Control Systems," 2 pages, 2002.
http://www.regionalwaterproofing.com/CactusBoard.html, "CactusBoard Floor Edging," 3 pages, Oct. 1, 2004.
http://www.korit.com/platon.html, "Platon Foundation Waterproofer," 2 pages, Oct. 1, 2004.

* cited by examiner

*Primary Examiner* — Eileen Lillis
*Assistant Examiner* — Jessica Laux
(74) *Attorney, Agent, or Firm* — Kagan Binder, PLLC

(57) ABSTRACT

The present invention is related to spacers that can create fluid flow space at a variety of structural interfaces, particularly in building construction. The spacers of the present invention include unique hinges that can physically couple one panel of the spacer to another panel of the spacer in a manner that substantially distortionally separates the two panels. Preferred embodiments include a folded hinge having at least two folds. The spacers of the present invention also include unique panel dimples that help control the rigidity of the panel. In preferred embodiments, elongated dimples are used to help control rigidity.

7 Claims, 9 Drawing Sheets

100
104
122
102
120
72.00

2.44
1.22
0.66
1.31
118
2.00
5/16 X 45 Deg
A
B
110

SECTION B-B 0.05
R0.09
0.50
80°
0.21
1.00
0.31
124
SECTION A-A 5.90
5.12
R0.093
45°
6.00

CONSTRUCTION SPACER

PRIORITY CLAIM

The present non-provisional patent application claims priority under 35 USC §119(e) from U.S. Provisional Patent Application having Ser. No. 60/634,880, filed on Dec. 10, 2004, by Cotten and titled CONSTRUCTION SPACER, wherein the entirety of said provisional patent application is incorporated herein by reference.

FIELD OF THE INVENTION

The present invention is related to spacers that can create fluid flow space at a variety of structural interfaces, particularly in building construction. For example, spacers according to the present invention can be used to create water-flow spaces between the edge of a floor and a wall and between a footing and the floor to help manage water around building foundations.

BACKGROUND OF THE INVENTION

The invasion of ground water into basements and other structures can cause numerous problems. Generally such water seeps into basements from the walls and perimeter of the floor at the floor-wall and wall-footing interfaces, and/or through floor cracks, due to external hydrostatic pressures of water in the ground.

Wall and sub-floor water-control systems (e.g., spacers) are known for receiving, channeling, collecting and expelling ground water from subterranean rooms having walls, wall-supporting footings, and a floor (e.g., basements), to beneath the floor and over the footing.

An example of a prior art spacer is illustrated in FIG. 1. Here, L-shaped spacer 10 includes a horizontal panel 15 and a vertical panel 20 connected at bend 35. Horizontal panel 15 includes hemispherical like dimples or depressions 25 that help support panel 15 above the top surface of footing 50. Similarly, vertical panel 20 includes hemispherical like dimples or depressions 30 that help support panel 20 apart from the surface of wall 60. Supporting panel 15 above footing 50 and panel 20 apart from wall 60 helps create spaces for water 80 to flow along water-flow path 85 and into a footing drain (not shown) and/or stone aggregate 70. Water 80 can enter the spaces between panel 15 and footing 50 and between panel 20 and wall 60 from places such as water-drain 75 and/or flowing down wall 60.

Panel 15 has horizontal panel lip 40 and panel 20 has vertical panel lip 45, both of which help prevent wet cement from flowing between panel 15 and footing 50 and between panel 20 and wall 60, respectively. Wet cement is poured to form floor 65.

Oftentimes, footings such as footing 50 are not flat, yet it is important for the bottom panel (i.e., panel 15) to conform to the irregularities in footing 50. A drawback of many spacers (e.g., spacer 10) is that if panel 15 flexes to conform to the irregularities in footing 50, such flexure tends to be transferred to and can cause vertical panel 20 to distort to an undue degree. Undue distortion in panel 20 can be aesthetically and/or functionally undesirable. For example, panel 20 can appear wavy and fail to properly seat against wall 60. This makes panel 20 unsightly and has been a significant barrier against commercial acceptance of this prior art device.

It is also important for panel 15 and/or 20 to have an appropriate balance between flexibility and rigidity. For instance, it may be important for panel 20 to be flexible enough that panel 20 can properly seat longitudinally against wall 60 along lip 45 yet be rigid enough to support panel 20 against floor 65 to create a fluid flow space between floor 65 and wall 60 and resist undue distortion if panel 15 flexes (flexure of panel 15 described above).

Creating spaces between a basement floor, wall, and footing is also described in U.S. Pat. No. 6,672,016 (Janesky), the entirety of which, is incorporated herein by reference.

There is a continuing need for new and improved devices that can create fluid flow space at a variety of structural interfaces in construction such as water-flow spaces at one or more of floor/wall interfaces and floor/footing interfaces.

SUMMARY OF THE INVENTION

The prior art spacer 10 shown in FIG. 1 suffers from the drawback that coupling one panel to another panel merely by a bend can allow flexure occurring in one panel, e.g., panel 15, to cause the other panel, e.g., panel 20, to distort to an undue degree. To help reduce or eliminate such distortion, the present invention physically couples a first panel to a second panel to form a spacer device for construction, yet allows flexure to occur in the first panel without causing the second panel to distort to an undue degree. Such coupling advantageously allows one panel of the spacer to flex to conform to irregularities that may be in a footing yet helps prevent such flexure from causing the other panel of the spacer to distort to an undue degree. In preferred embodiments, this is achieved by coupling the panels together with a compressible hinge structure that helps to absorb distortion forces and substantially reduce distortion that might otherwise be induced among coupled panels.

It has also been discovered that providing a plurality of elongated dimples on a panel can help control the flexibility and rigidity in the panel. For example, a plurality of elongated dimples on a spacer panel can provide a desired level of flexibility and rigidity in the panel. Staggering and/or overlapping dimples such as elongated dimples in one or more directions can also help control rigidity. For example, elongated dimples can be staggered or overlapped longitudinally along a panel and/or across the width of a panel. In general, the more the dimples are staggered and/or overlapped, the more rigid the panel is. Advantageously, such a panel is flexible enough to properly conform to the wall yet rigid enough to support the panel between the floor and the wall to create a fluid-flow space between the floor and wall and rigid enough to resist undue distortion if the other panel of the spacer flexes. As another advantage, elongated dimples can make trowelling cement adjacent the dimples easier.

According to one aspect of the present invention, a spacer for a structural interface in construction includes a first panel, a second panel, and a hinge physically coupling the first panel to the second panel in a manner that substantially distortionally separates the first panel from the second panel.

According to another aspect of the present invention, a spacer for a structural interface in construction includes a first panel, a second panel, and a hinge having two or more folds, wherein the hinge physically couples the first panel to the second panel. In preferred embodiments, the hinge includes 2 to 10, more preferably 3 to 7 folds, and even more preferably 5 folds. In preferred embodiments, the first panel, second panel, and hinge form a unitary spacer.

According to another aspect of the present invention, a spacer for a structural interface in construction includes a first panel, a second panel, and a compressible hinge physically coupling the first panel to the second panel.

According to another aspect of the present invention, a first panel for a structural interface spacer in construction includes a first interlocking portion that can interlock with a second interlocking portion of a second panel to form a hinge, wherein the hinge can physically couple the first panel to the second panel in a manner that substantially distortionally separates the first panel from the second panel. Preferably, this panel is combined with a second panel to form a spacer for a structural interface in construction. Preferably, the second panel includes a second interlocking portion, wherein the first and second interlocking portions interlock to form a hinge to physically couple the first panel to the second panel in a manner that substantially distortionally separates the first panel from the second panel. In preferred embodiments, the hinge includes caulk to help seal the interlocking portion between the first and second interlocking portions.

According to another aspect of the present invention, a spacer for a structural interface in construction includes a first panel including a first longitudinal end, a second panel including a first longitudinal end, wherein the first longitudinal ends of the first and second panels are adjacent to each other in a manner to form an L-shaped spacer, and a hinge including caulk, wherein the hinge physically couples the first panel to the second panel in a manner that substantially distortionally separates the first panel from the second panel.

According to another aspect of the present invention, a kit for a structural interface spacer in construction includes a first panel including a first interlocking portion, a second panel including a second interlocking portion, wherein the first and second interlocking portions can interlock to form a hinge that can physically couple the first panel to the second panel in a manner that substantially distortionally separates the first panel from the second panel, and instructions indicating how to assemble the first and second panel to form a structural interface spacer. In preferred embodiments, the kit includes a container of caulk to help seal the interlocking portion of the hinge.

In preferred embodiments, the first and/or second panels include a plurality of elongated dimples.

According to another aspect of the present invention, a spacer for a structural interface in construction includes a first panel, a second panel comprising a plurality of elongated dimples, and a hinge physically coupling the first panel to the second panel.

DETAILED DESCRIPTION

The embodiments of the present invention described below are not intended to be exhaustive or to limit the invention to the precise forms disclosed in the following detailed description. Rather a purpose of the embodiments chosen and described is so that the appreciation and understanding by others skilled in the art of the principles and practices of the present invention can be facilitated.

In general, spacers according to the present invention can be used to create fluid flow space at a variety of structural interfaces in construction. One particularly useful context in which spacers of the present invention can be used is in proximity to a concrete footing, concrete wall, and concrete floor (e.g., in a basement). Here, an L-shaped spacer of the present invention can form a space between the edge of a basement floor and the wall, and between at least part of the footing and the concrete floor. These spaces allow water (e.g., from the perimeter and the walls) to flow into footing drains, sump liners, drain tile, stone aggregate under the floor, and the like. A spacer according to the present invention could be used between other structural interfaces in building construction such as between above-ground floors in a building. A spacer according to the present invention could be used in proximity to building structures made out of material other than concrete (e.g., wood). Other fluids besides water (e.g., air) could pass through the fluid-flow spaces created by such spacers.

Figure 6:
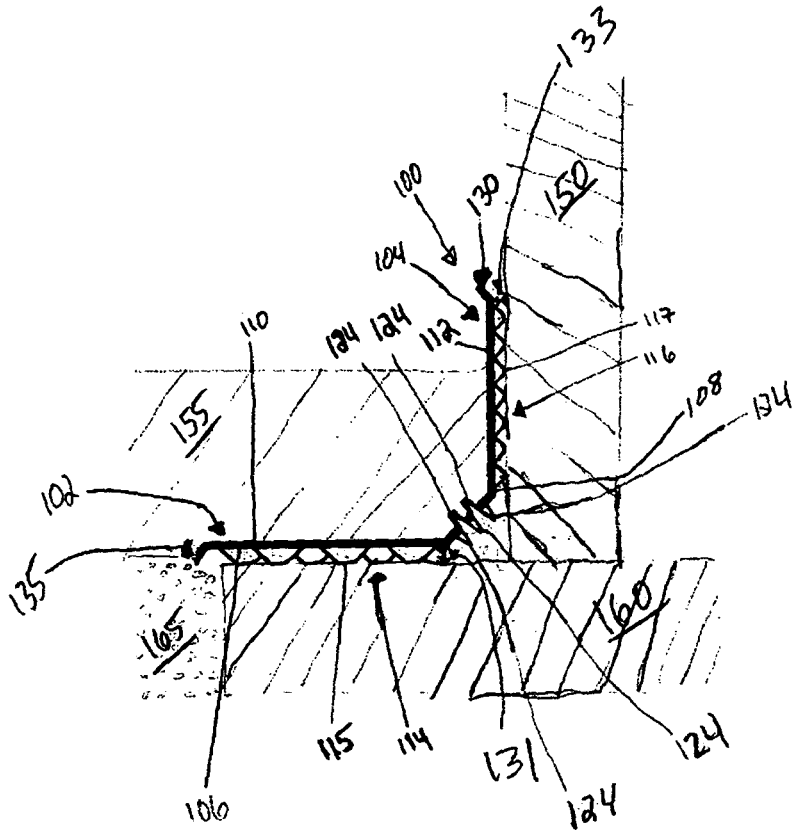
FIG. 6 shows the spacer of FIG. 2 along Section A-A positioned between a footing, a wall, and a concrete floor.
Figure 7:
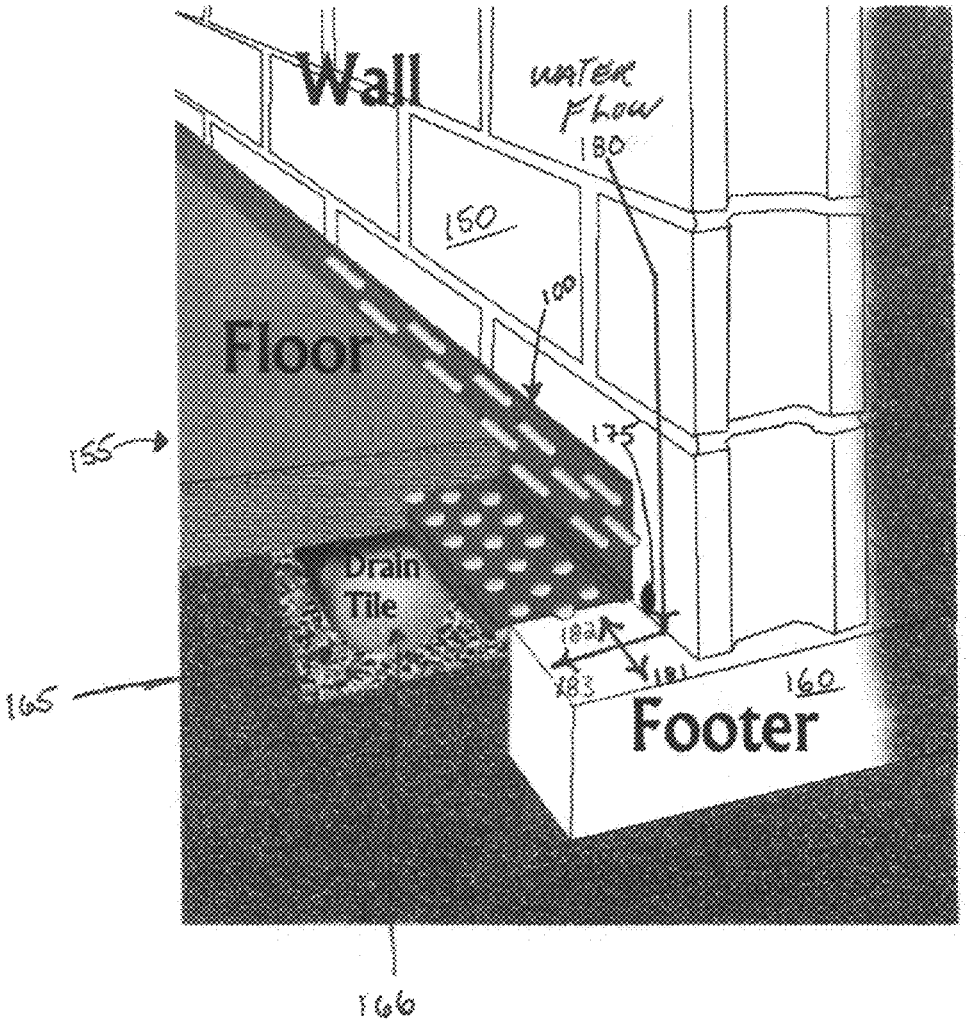
FIG. 7 shows a perspective view of the illustration shown in FIG. 6.

An exemplary spacer for a structural interface in construction according to the present invention is described below with reference to FIGS. 2, 3, 4, 5*a*, and 5*b*. As shown, L-shaped spacer 100 includes first panel 102, second panel 104, and hinge 122 which physically couples first panel 102 to second panel 104. An exemplary use of the spacer 100 is illustrated in FIGS. 6 and 7.

First panel 102 has a first major surface 106, a second major surface 110, first panel longitudinal border 135, and a plurality of dimples 114.

Preferably, as shown, dimples 114 have conically shaped sides that taper from first major surface 106 to a frustum or flat contact area 115. Flat contact area 115 contacts the opposing surface of footing 160 to help create a fluid-flow space 131 between first major surface 106 of first panel 102 and footer 160 to permit fluids (e.g., water) to flow therebetween. Preferably, as shown, dimples 114 include indented portion 118 (see FIG. 2) of the second major surface 110. As shown in FIG. 6, when spacer 100 is positioned in the L-shaped intersection of wall 150 and footer 160, cement can be poured to form floor 155. When the cement is in a fluid state during pouring, the openings of indented portions 118 are large enough such that the cement can displace the air in indentations 118 and fill indentations 118 down to contact areas 115. After curing, the cement that has filled indentations 118 can support first panel 102 against footer 160 and help prevent collapse or narrowing of the fluid-flow space 131 between first major surface 106 of first panel 102 and footer 160.

First panel longitudinal border 135 extends longitudinally along the edge of first panel 102. Preferably, as shown, border 135 extends beyond the edge of footing 160 and preferably is angled downwardly towards stone aggregate 165 to hinder the flow of wet cement under first panel 102 and into the fluid-flow space 131. First panel 104 has a width so that the angled-down portion of border 135 extends beyond the outer edge of footing 160 a distance sufficient to also help prevent wet concrete from any back flow under panel 102 which could block the flow of, e.g., water from space 131 into stone aggregate 165.

Second panel 104 has a first major surface 108, a second major surface 112, second panel longitudinal border 130, and a plurality of dimples 116.

Preferably, as shown, second panel dimples 116 are elongated. Preferably, elongated dimples have sides that taper from first major surface 108 to a rounded contact area 117. Rounded contact area 117 contacts the opposing surface of wall 150 to help create a fluid-flow space 133 between first major surface 108 of second panel 104 and wall 150 to permit fluids (e.g., water) to flow therebetween.

As mentioned, having elongated dimples such as dimples 116 can help control the level of flexibility and rigidity in a spacer panel such as panel 104. Preferably, as shown, dimples 116 are substantially parallel to the longitudinal edges of panel 104.

Advantageously, elongated dimples 116 allow panel 104 to be flexible enough to properly conform to wall 150 yet be rigid enough to support panel 104 between floor 155 and wall 150 to help create and maintain fluid-flow space 133 between floor 155 and wall 150. Dimples 116 also enhance the rigidity of panel 104 such that panel 104 is more resistant to undue distortion if panel 102 flexes.

Figure 1:
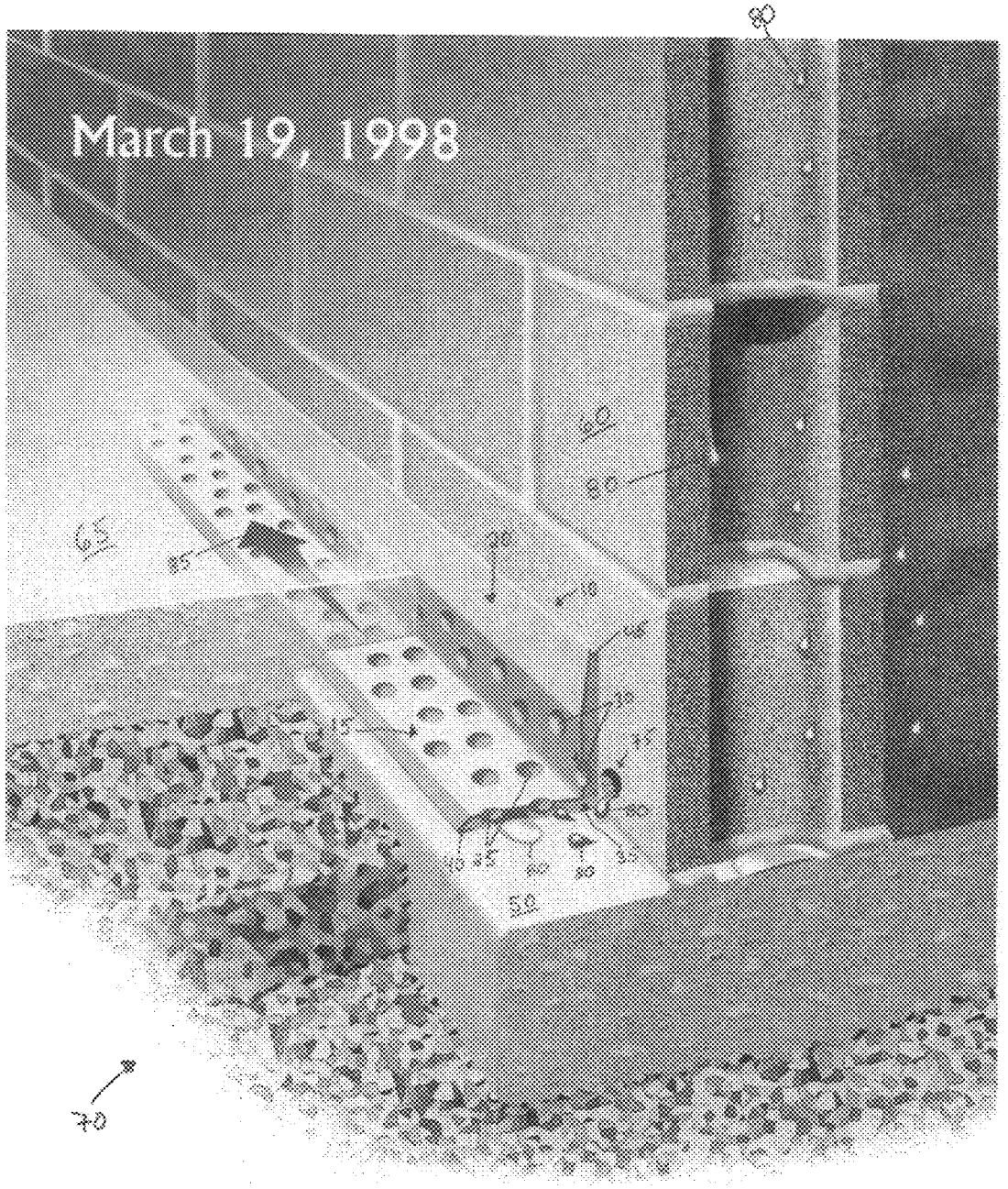
FIG. 1 (PRIOR ART)
FIG. 1 illustrates a perspective view of a Prior Art water-drain panel.

As another advantage, elongated dimples 116 help make it easier to use a trowel to help guide wet cement into dimples 116 that are at the same level as floor 155. As a trowel is guided along second panel 104 to help fill dimples 116 with wet cement and form the floor surface, an elongated dimple 116 allows the corner of a trowel to be smoothly guided into dimple 116, through the trough of dimple 116, and out of dimple 116. Such smooth trowelling can be highly desirable, especially when trying to form a smooth floor surface. Certain other styles of dimples (e.g., hemispherical like dimples 30 in FIG. 1) typically disrupt the trowelling motion along the panel so as to cause the wet cement to form a rough surface thereby making the trowelling process longer and more challenging.

Staggering and/or overlapping dimples such as elongated dimples 116 in one or more directions can control rigidity. For example, as shown, elongated dimples 116 are staggered longitudinally along panel 104 and overlapping across the width of a panel 104. In general, the more that elongated dimples are staggered and/or overlapped, the more rigid the panel will be. And the more longitudinally staggered and/or overlapping dimples there are per unit length of a panel, the more rigid a panel will be.

Preferably, as shown, dimples 116 include indented portion 120 (see FIG. 3) on the second major surface 112. As illustrated in FIG. 6, when spacer 100 is positioned in the L-shaped intersection of wall 150 and footer 160, cement can be poured to form floor 155. When the cement is in a fluid state during pouring, the openings of indentations 120 are large enough such that the cement can displace the air in indentations 120 and fill such indentations 120 down to contact areas 117. After curing, the cement that has filled indentations 120 can support second panel 104 against wall 150 and help prevent collapse or narrowing of the fluid-flow space 133 between first major surface 108 of second panel 104 and wall 150.

Optionally, as shown, indentations 118 in panel 102 have a greater depth (or height) than indentations 120 in panel 104 to provide a larger fluid-flow (e.g., water-flow) space 131 between panel 102 and footing 160.

As mentioned, the openings of indentations 118 and 120 enable wet concrete to flow into the openings of tapered indentations 118 and 120 to fill them and form, preferably uniformly spaced, cured concrete posts or stand-offs which provide uniform structural strength between concrete floor 155, wall 150, and footing 160. Also, as shown, the plurality of uniformly spaced, relatively small contact areas 115 and 117 help minimize the overall area of spacer 100 which contacts the wall 150 and footing 160 and help maximize the area of the wall 150 and footing 160 which is free of contact and is open to the free flow of fluid (e.g., water). The tapered shape of the indentations 118 and 120 facilitates the flow of wet cement to fill the indentations and also helps minimize the space within the fluid flow spaces 133 and 131 which is displaced by the indentations, to help maximize the capacity of fluid-flow (e.g., water-flow) in spaces 133 and 131.

Preferably, indentations 118 and 120 are arranged to enable two or more spacers to be nested and stacked, to minimize packaging and storage space, and to enable adjacent spacers to be overlapped by one or more indentation lengths to conform to the overall length of the wall/footing area being covered, and to be overlapped at an angle of 90 degrees in corner areas, if desired. Otherwise the spacers can be cut to desired lengths and angles, butted together, and caulked if desired.

Second panel longitudinal border 130 extends longitudinally along the edge of second panel 104. Preferably, as shown, border 130 extends beyond floor 155 and is angled away from wall 150. Such a configuration can hinder wet concrete from flowing between second panel 104 and wall 150 and into the fluid-flow space 133. Such a configuration can also permit water to flow down the surface of wall 150, such as from cracks, down into fluid flow spaces 133 and 131. Border 130 can be left in place after the cement is poured and cured to form floor 155, or panel 104 may be cut along the floor line, after the floor 155 is cured, in order to admit fluid such as water from the floor 155 into fluid-flow space 133. Optionally, the inlet of space 133 near border 130 may be sealed along its length by applying caulk or a water-permeable strip member (not shown) such as an open-cell foam of elastomeric material. The strip member may be adhesively-bonded to panel 104 and/or to the wall 150 and/or between a portion of support members 116 in space 133.

A hinge for a spacer according to the present invention physically couples one panel of the spacer to another panel of the spacer in a manner that substantially distortionally separates the two panels. In preferred embodiments according to the present invention, a compressible hinge can be used. A compressible hinge tends to absorb distortions caused by flexure in one panel and helps protect the other panel from unduly distorting as a result of such flexure. An example of a hinge according to the present invention includes a hinge having two or more folds. Hinge 122 is an example of a preferred, compressible hinge according to the present invention.

Hinge 122 physically couples panel 102 to panel 104 along a longitudinal edge of each panel. Preferably, as shown, hinge 122 includes five folds 124 that define pointed apexes (See FIGS. 5*a*, 5*b*, and 6). As used herein, a "fold" of a hinge preferably is defined by each apex of the hinge (see, e.g., folds 124). For example, a fold can be defined by first bending a sheet like material 180 degrees along a length so as to double up the material and define two panel like portions and then bending part of one panel like portion back beyond 90 degrees so as to define a fold. Such a fold can cause the sheet like material to decrease in width as the fold is bent further and/or cause the sheet like material to increase in width as the fold is unfolded or unbent. A fold can also be formed by molding processes. The number of folds in a folded hinge according to the present invention can range from two (2) folds to multiple folds. The size of the folds can be relatively large or small. In general, for a folded hinge according to the present invention to suitably distortionally separate a panel, the size of the fold(s) should increase as the number of folds decreases. Relatively small size folds are preferred because, e.g., spacers like spacer 100 are easier to manufacture and use when the folds are relatively smaller. For a given fold size, a folded hinge according to the present invention tends to distortionally separate a panel better as the number of folds increases. As the number of folds increases, a point is usually reached where additional folds provide marginal benefit with regards to distortion separation such that the cost to make an additional fold outweighs the distortion separation benefit. Given these considerations, a preferred number of folds includes from two (2) to ten (10) folds, even more preferred from three (3) to seven (7) folds, and even more preferred is five (5) folds.

The shape of fold apexes can be pointed, rounded, and the like, as long as they help substantially distortionally separate a panel. Preferably, the shape for a fold apex is relatively pointed as shown by folds 124. These are easier to manufacture and tend to absorb distortion forces better.

Advantageously, a hinge according to the present invention such as hinge 122 allows first panel 102 to flex, if necessary, to conform to irregularities that may be on the surface of footing 160 yet helps prevent such flexure from causing panel 104 to distort to an undue degree. A hinge such as 122 allows spacer 100 to be more aesthetically and/or functionally desirable.

Preferably, as shown, panels 102 and 104, and hinge 122 form a unitary spacer 100 (e.g. are fabricated from a single sheet). The hinge of a unitary spacer tends to be more resistant to certain fluids (e.g., water, wet cement) passing through spacer 100. The unitary structure is also easier to package, ship, and install.

Figures 2, 3, 4, 5A, 5B:
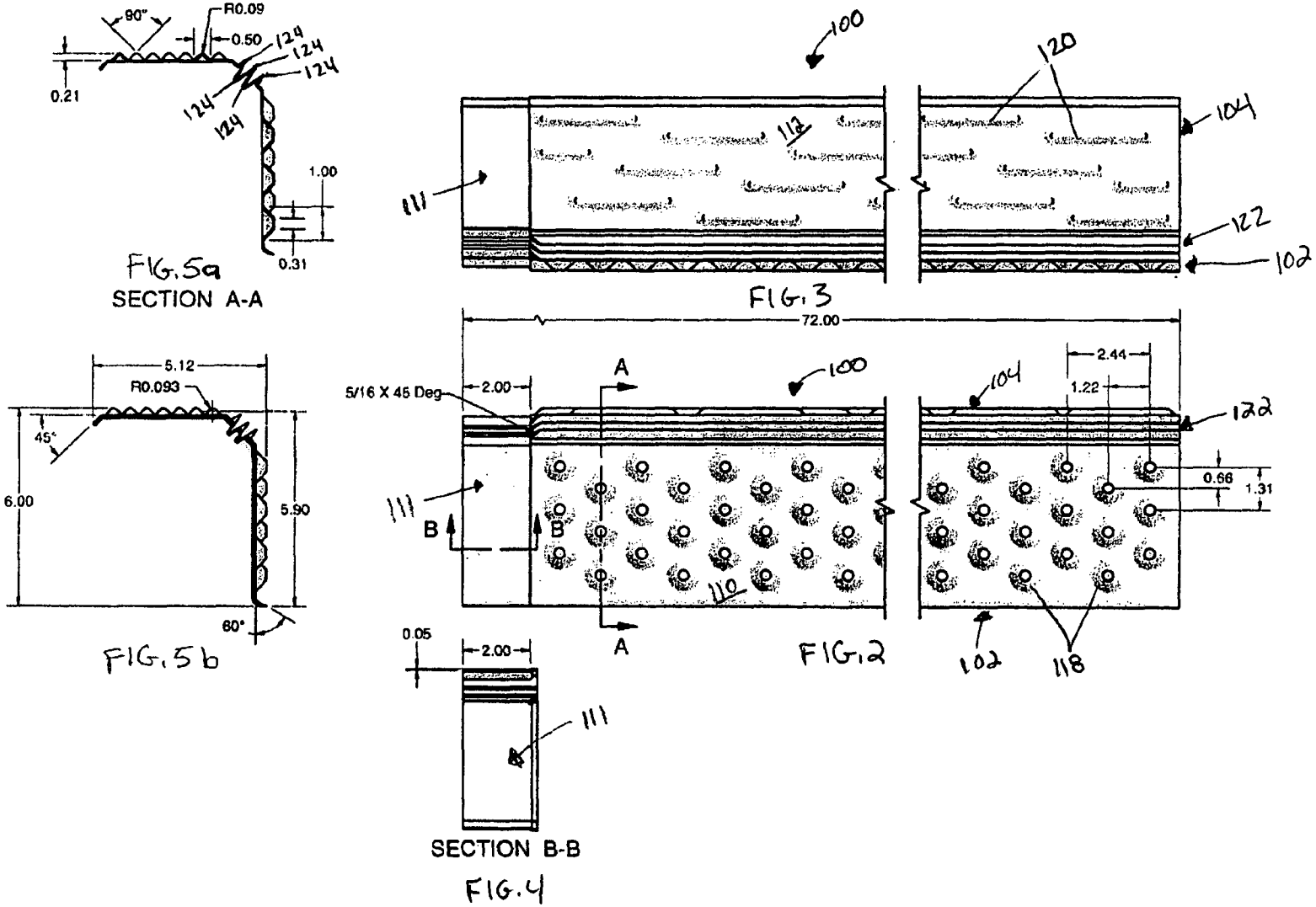
FIG. 2 shows a plan view of an L-shaped spacer according to the present invention.
FIG. 3 shows a elevation view of the spacer in FIG. 2.
FIG. 4 shows the spacer of FIG. 2 along Section B-B.
FIGS. 5*a* and 5*b* show the spacer of FIG. 2 along Section A-A.

Optionally, a spacer according to the present invention can include one or more offset areas that can be used to overlap adjacent spacers and help create a continuous spacer. Preferably, as shown in FIGS. 2-4, spacer 100 includes offset area 111 that longitudinally extends from first panel 102, second panel 104, and hinge 122.

A spacer according to the present invention can be made from any material suitable for its intended use. Such materials include plastics (e.g., thermoplastics and thermosets), metal formulations, and the like. A particularly preferred material includes polystyrene (e.g., gray virgin super high impact polystyrene).

A spacer according to the present invention can be sold individually or in bulk. Typically, one or more spacers are sold in kits with instructions on how to use a spacer as a structural interface in construction.

Spacers according to the present invention can be installed by methods well-known in the art. An exemplary procedure of installing one or more spacers according to FIGS. 2-5*b* is described in connection with FIGS. 6 and 7.

In general, footing 160 is prepared by, e.g., scraping off the top surface of footing 160 around the inside perimeter of the foundation. Lengths of L-shaped spacers 100 (typically six feet in length) can be closely positioned in the L-shaped intersection of footing 160 and wall 150 so that wet cement can be poured to form floor 155. As shown, L-shaped spacer 100 is positioned such that dimples 114 are facing footer 160 and dimples 116 are facing wall 150. In this position, spacer 100 forms spaces 133 (between second panel 104 and wall 150) and 131 (between first panel 102 and footing 106).

Lengths of the L-shaped spacers can be trimmed to fit corners and/or spaces less than full-length. For example, a plastic spacer according to the present invention can be measured and cut with tin snips.

Optionally, spacer 100 can be fastened in place with, e.g., masonry nails. Additional water-control hardware can be installed such as sump liners, sump pumps, footing drains, drain tile, and the like.

Prior to forming floor 155, footing 160 is back-filled with stone-aggregate 165 before or after installing spacer 100. After spacer 100, stone aggregate 165, and drain tile 166 are in position, wet cement can be poured, trowelled, cured, and the like, so as to form floor 155. Floor 155 is installed in a way to preferably preserve fluid flow spaces 133 and 131. These spaces allow water to flow into one or more of drain tile 166 and stone aggregate 165. As shown, water can flow down wall 150 via path 180 and/or out of drain 175 onto footer 160. Water on top of footer 160 can flow along footer 160 via paths 181, 182, and/or 183, and into one or more of stone aggregate 165 and drain tile 166.

FIGS. 8-12, described below, illustrate alternative embodiments of a spacer according to the present invention.

Figure 8:
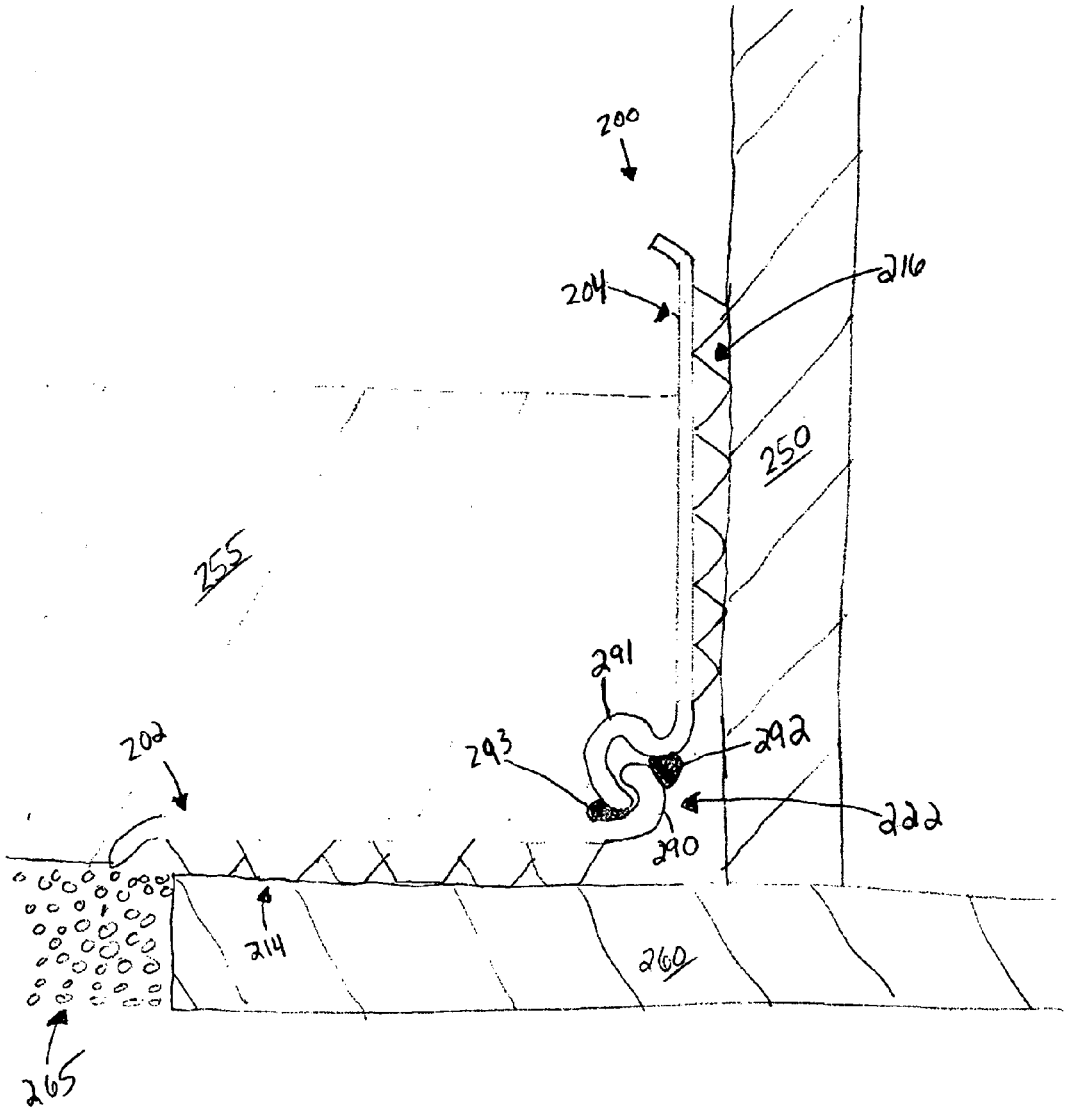
FIG. 8 shows a cross-sectional view of an alternative embodiment of a spacer according to the present invention.

FIG. 8 illustrates an alternative embodiment of a spacer according to the present invention. As shown, spacer 200 includes first panel 202, second panel 204, and hinge 222 which physically couples first panel 202 to second panel 204 in a manner that substantially distortionally separates first panel 202 from second panel 204. First panel 202 includes dimples 214 which are the same as dimples 114 and second panel 204 includes dimples 216 which are the same as dimples 116 (dimples 114 and 116 are described above with respect to spacer 100). Hinge 222 includes a first interlocking portion 290 of first panel 202 and second interlocking portion 291 of second panel 204. Optionally, hinge 222 can include one or more portions (e.g., beads) 292 and 293 of bonding material such as caulk.

L-shaped spacer 200 is positioned such that first panel 202 is between floor 255 and footer 260 and second panel 204 is between floor 255 and wall 250. Footer 260 is back-filled with stone aggregate 265.

Figure 9:
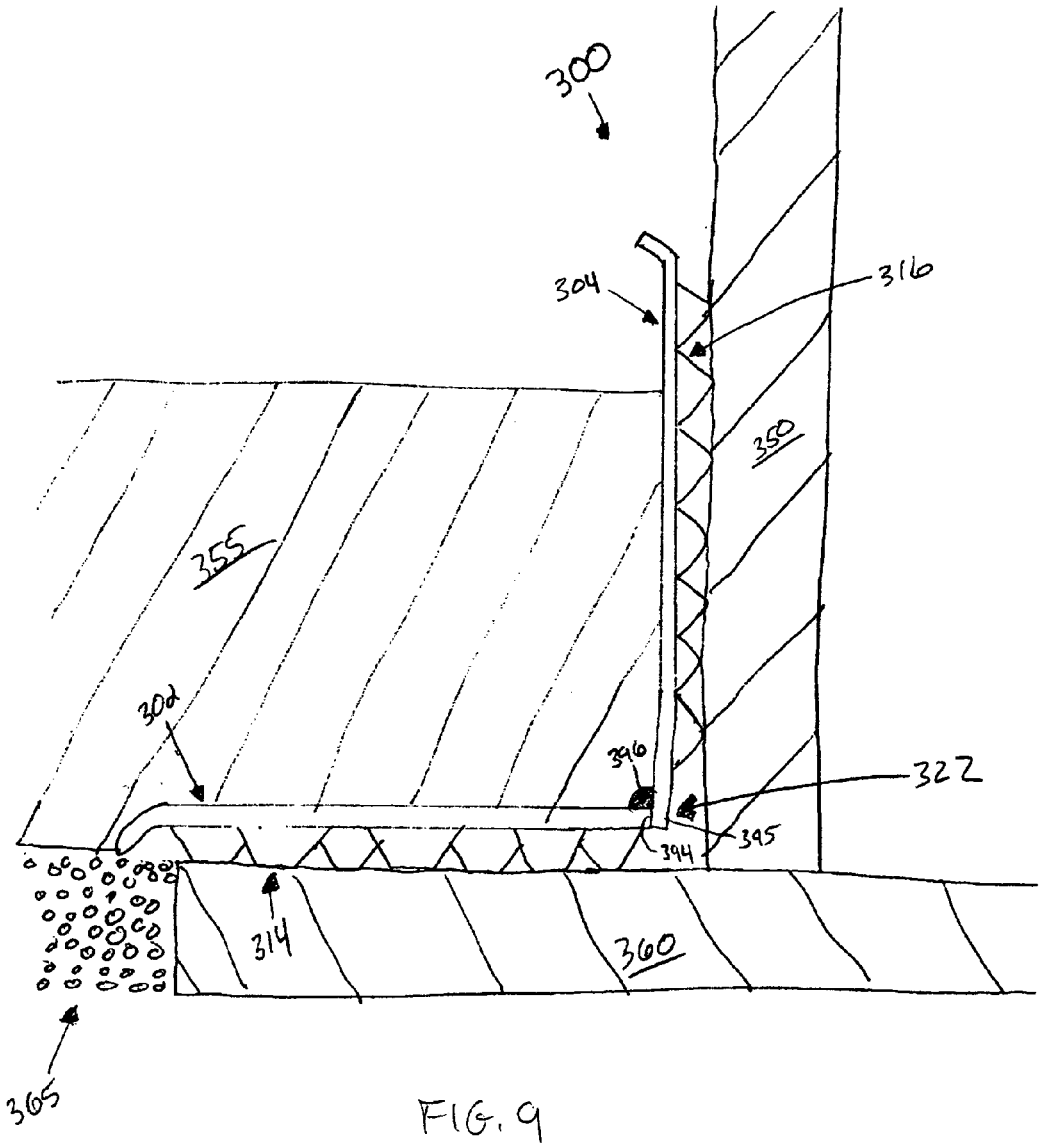
FIG. 9 shows a cross-sectional view of an alternative embodiment of a spacer according to the present invention.

FIG. 9 illustrates an alternative embodiment of a spacer according to the present invention. As shown, spacer 300 includes first panel 302, second panel 304, and hinge 322 which physically couples first panel 302 to second panel 304 in a manner that substantially distortionally separates first panel 302 from second panel 304. First panel 302 includes dimples 314 which are the same as dimples 114 and second panel 304 includes dimples 316 which are the same as dimples 116 (dimples 114 and 116 are described above with respect to spacer 100). Hinge 322 includes abutting ends 394 and 395 of first panel 302 and second panel 304, respectively, and one or more portions (e.g., beads) 396 of bonding material such as caulk.

L-shaped spacer 300 is positioned such that first panel 302 is between floor 355 and footer 360 and second panel 304 is between floor 355 and wall 350. Footer 360 is back-filled with stone aggregate 365.

Figure 10:
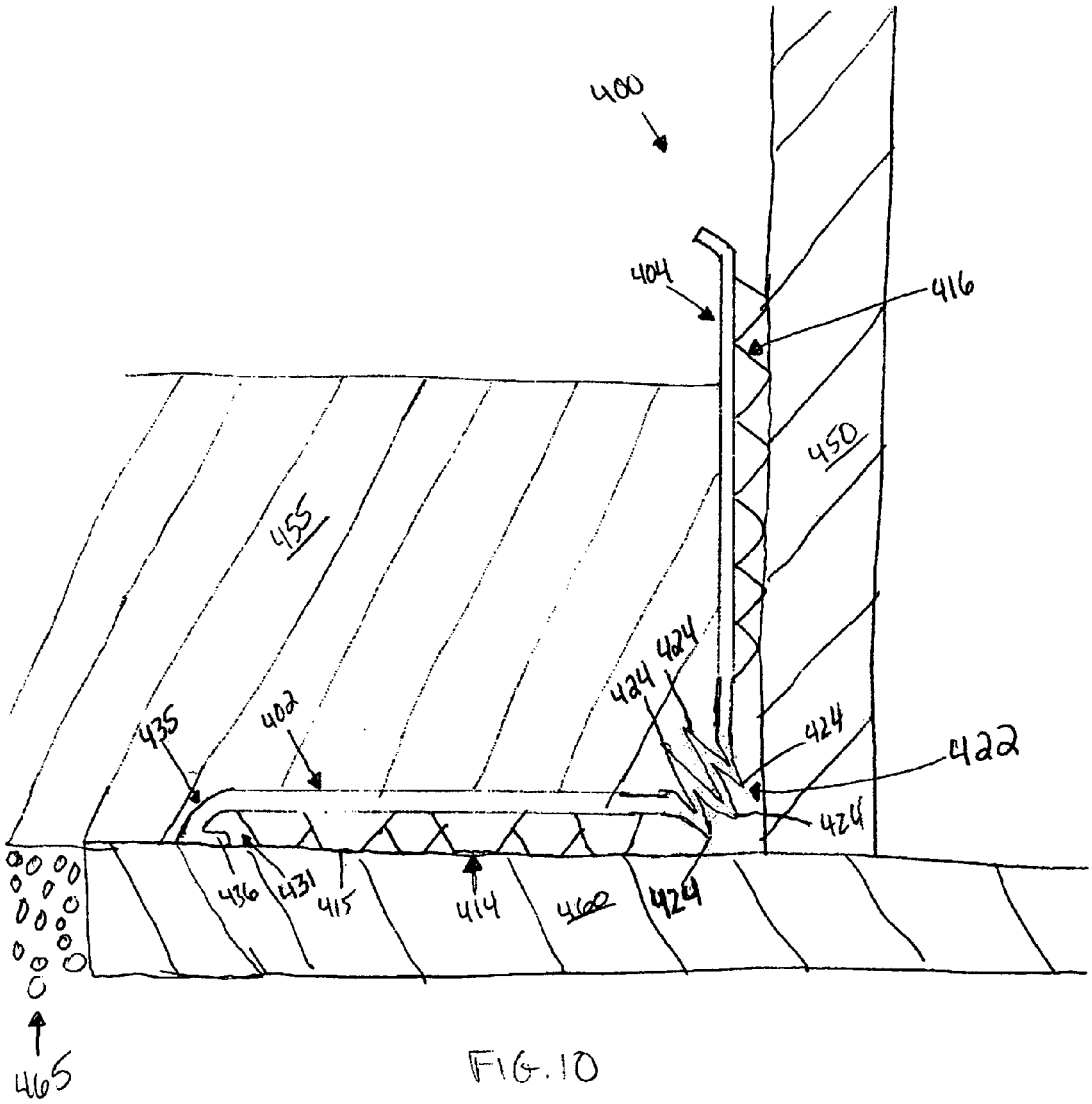
FIG. 10 shows a cross-sectional view of an alternative embodiment of a spacer according to the present invention.

FIG. 10 illustrates an alternative embodiment of a spacer according to the present invention. As shown, spacer 400 includes first panel 402, second panel 404, and hinge 422 which physically couples first panel 402 to second panel 404 in a manner that substantially distortionally separates first panel 402 from second panel 404. First panel 402 includes dimples 414 which are the same as dimples 114 and second panel 404 includes dimples 416 which are the same as dimples 116 (dimples 114 and 116 are described above with respect to spacer 100). Hinge 422 includes folds 424 that define pointed apexes.

L-shaped spacer 400 is positioned such that first panel 402 is between floor 455 and footer 460 and second panel 404 is between floor 455 and wall 450. Footer 460 is back-filled with stone aggregate 465. First panel 402 includes first panel longitudinal border 435, which includes a lip 436 that angles down towards footing 460 and back towards wall 450. Lip 436 is substantially flush with contact surfaces 415 of dimples 414 such that the angled back-portion of lip 436 substantially contacts footer 460 when contact surfaces 415 contact footer 460. As shown, lip 436 does not hang over the edge of footer 460 such that water can flow into stone aggregate 465 at this particular point. Water can flow along footer 460 and into one or more of stone aggregate at another point, footer drains, and the like. Lip 436 preferably hinders and/or prevents wet cement from flowing under panel 402, which can reduce fluid-flow space 431 under panel 402.

Figure 11:
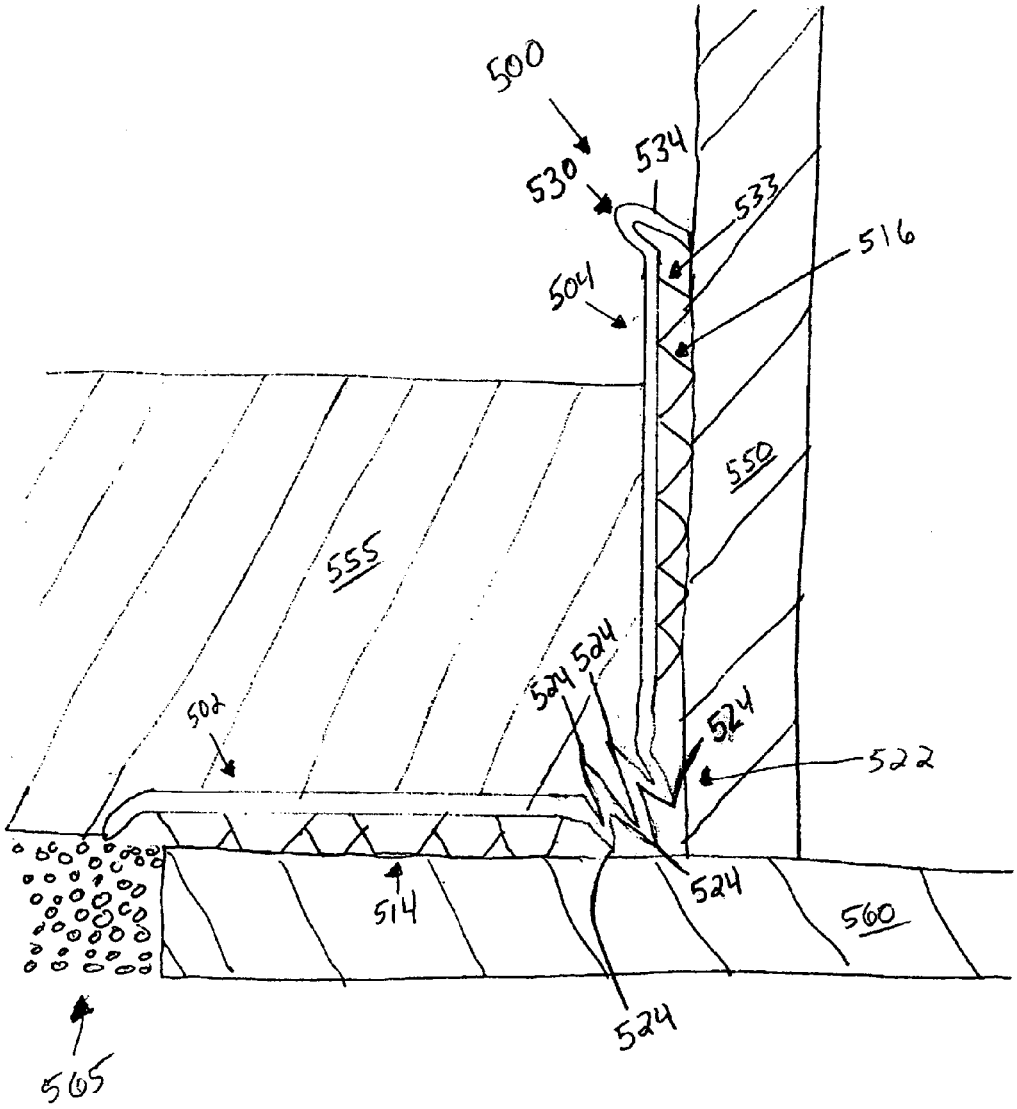
FIG. 11 shows a cross-sectional view of an alternative embodiment of a spacer according to the present invention.

FIG. 11 illustrates an alternative embodiment of a spacer according to the present invention. As shown, spacer 500 includes first panel 502, second panel 504, and hinge 522 which physically couples first panel 502 to second panel 504 in a manner that substantially distortionally separates first panel 502 from second panel 504. First panel 502 includes dimples 514 which are the same as dimples 114 and second panel 504 includes dimples 516 which are the same as dimples 116 (dimples 114 and 116 are described above with respect to spacer 100). Second panel 504 also includes second panel longitudinal border 530, which includes lip 534 angled towards or against wall 550. Lip 534 can help prevent any wet concrete from entering fluid-flow space 533 when concrete is being poured, trowelled, and the like. If wet concrete enters the fluid-flow space 533, the fluid-flow space 533 can undesirably be reduced. Optionally, after floor 555 is formed, border 530 can be cut off or panel 504 can be cut along the floor line using a cutting blade tool. Hinge 522 includes folds 524 that define pointed apexes.

L-shaped spacer 500 is positioned such that first panel 502 is between floor 555 and footer 560 and second panel 504 is between floor 555 and wall 550. Footer 460 is back-filled with stone aggregate 565.

Figure 12:
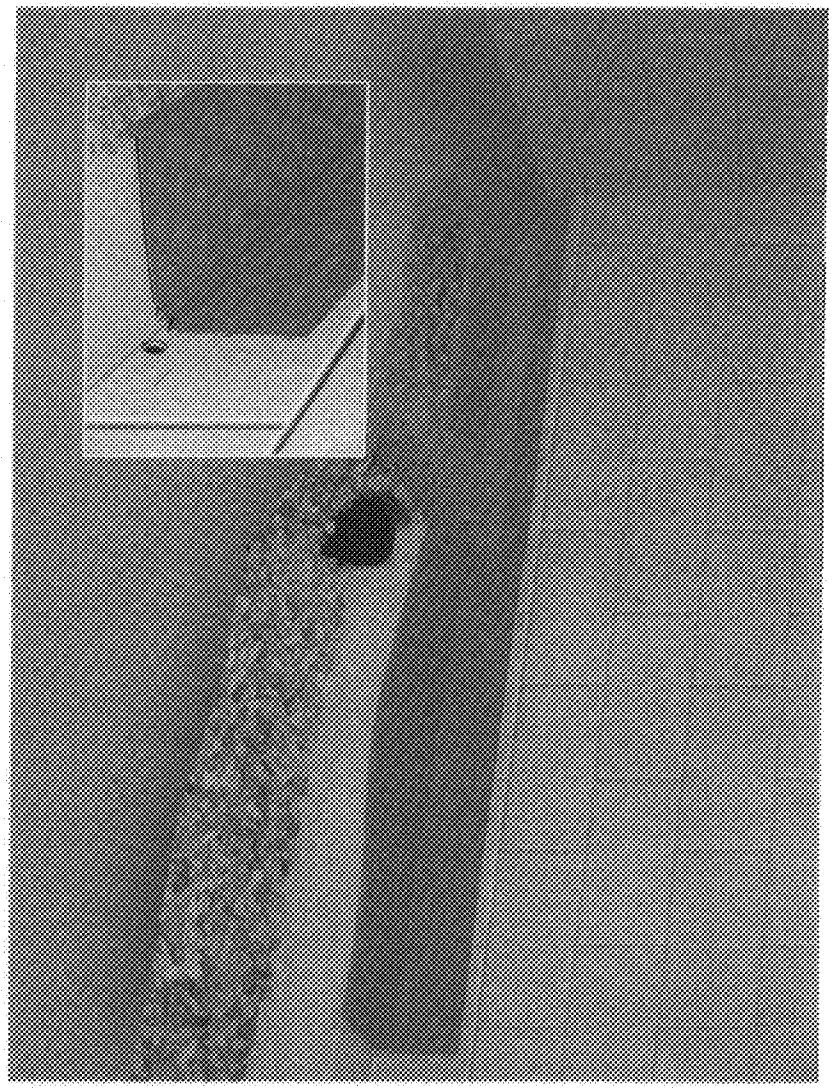
FIG. 12 shows a perspective view of an alternative embodiment of a spacer according to the present invention.

FIG. 12 shows a perspective view of an alternative embodiment of a spacer according to the present invention that is similar to spacer 100. The L-shaped spacer in FIG. 12 has a first panel that lies on top of a foundation footing and a second panel that lies next to a concrete block wall. As best seen by the insert of FIG. 12, the two panels are joined together by a compressible hinge. The hinge has five (5) folds defined by relatively pointed apexes. The first panel has frusto-conical dimples and the second panel has elongated dimples. As best seen by the insert of FIG. 12, the first panel has a longitudinal border that extends beyond the footing and is angled down towards the stone aggregate and drain tile. The insert of FIG. 12 also shows the longitudinal border of the second panel located above the floor and angled away from the wall. The first and second panels help create a fluid flow space that allows, e.g., water from the water drain shown in FIG. 12 insert to flow into the stone aggregate and/or drain tile. Advantageously, the hinge of the spacer in FIG. 12 allows the first panel to flex to conform to the irregularity on the surface of the footing yet helps prevent such flexure from causing the second panel to distort to an undue degree. Such a hinge allows the second panel of the spacer to be more aesthetically and/or functionally desirable.

What is claimed is:

1. A construction spacer for an interface comprising a horizontal surface and a vertical surface meeting at a corner comprising:

a first panel;

a second panel;

a hinge that is unitary with the first and second panels and couples the first panel to the second panel, wherein the hinge allows the spacer to be positioned at the interface such that the first panel overlies the horizontal surface and the second panel overlies the vertical surface, wherein the hinge is foldably coupled to the first panel along a longitudinal edge of the first panel and is foldably coupled to the second panel along a longitudinal edge of the second panel; and wherein the hinge further comprises at least two additional zig zag folds to allow the hinge to be increased and decreased in width in a manner effective to help distortionally separate the first panel from the second panel such that the hinge absorbs distortion forces to reduce induced distortion among panels when the panels conform to an irregularity in an underlying surface;

a first plurality of longitudinally elongated dimples projecting from the first panel in a manner effective to support the first panel from the horizontal surface in a manner to define a fluid flow space between the first panel and the horizontal surface, said dimples being filled with a cured cement; and a second plurality of longitudinally elongated dimples projecting from the second panel in a manner effective to support the second panel from the horizontal surface in a manner to define a fluid flow space between the second panel and the vertical surface, said dimples being filled with a cured cement.

2. The spacer according to claim 1, wherein at least one of the fold apexes is substantially pointed.

3. The spacer according to claim 2, where all of the fold apexes are substantially pointed.

4. The spacer according to claim 1, wherein the first panel, second panel, and hinge form a unitary spacer.

5. The spacer according to claim 1, wherein the hinge comprises 3 to 7 folds.

6. The spacer according to claim 5, wherein the hinge comprises 5 folds.

7. The spacer according to claim 1, wherein the first plurality of dimples are staggered across the width of the first panel.

* * * * *